United States Patent [19]

Maeda et al.

[11] 4,307,277

[45] Dec. 22, 1981

[54] MICROWAVE HEATING OVEN

[75] Inventors: Susumu Maeda; Yoshibumi Minowa; Hirotsugu Komura, all of Amagasaki, Japan

[73] Assignee: Mitsubishi Denki Kabushiki Kaisha, Tokyo, Japan

[21] Appl. No.: 62,790

[22] Filed: Aug. 1, 1979

[30] Foreign Application Priority Data

Aug. 3, 1978 [JP] Japan ..... 53-95249
Oct. 2, 1978 [JP] Japan ..... 53-121731
Jun. 26, 1979 [JP] Japan ..... 54-87776[U]

[51] Int. Cl.[3] ..... H05B 6/64
[52] U.S. Cl. ..... 219/10.55 R; 219/10.55 A
[58] Field of Search ..... 219/10.55 R, 10.55 A, 219/10.55 M, 10.55 E; 264/25, 26, 27

[56] References Cited

U.S. PATENT DOCUMENTS 3,585,258 6/1971 Levinson ..... 264/26
3,961,569 6/1976 Kenyon et al. ..... 219/10.55 A X
4,147,911 4/1979 Nishitani ..... 219/10.55 M

FOREIGN PATENT DOCUMENTS 52-30938 3/1977 Japan ..... 219/10.55 M
53-44694 11/1978 Japan ..... 219/10.55 R

OTHER PUBLICATIONS

Berteaud & Badot, "High Temp. Microwave Heating in Refractory Materials", Journal of Microwave Power, 11(4), 1976, pp. 315-320.

*Primary Examiner*—Gene Z. Rubinson
*Assistant Examiner*—Philip H. Leung
*Attorney, Agent, or Firm*—Oblon, Fisher, Spivak, McClelland & Maier

[57] ABSTRACT

A microwave heating oven comprises an inner casing or particles as an inner casing which is made of a material being heated by microwave in which a material being heated is placed; an intermediate casing made of a refractory insulator which causes less microwave loss and which covers said inner casing or particles; and means for applying the microwave from outside of the intermediate casing into the inner casing or particles.

The microwave heating furnace can be used for uniformly heating the material at high temperature with small electric power. A ceramic and a porcelain can be prepared by a household microwave oven as one of the microwave heating furnaces.

1 Claim, 13 Drawing Figures

MICROWAVE HEATING OVEN

BACKGROUND OF THE INVENTION

1. Field of Invention

The present invention relates to a microwave heating oven which heats a material by applying microwave. More particularly, it relates to an improvement for heating uniformly a material at high temperature.

2. Description of the Prior Arts

A microwave heating oven has been used for preparing a sintered product of ceramic, earthen ware or a metal oxide having zinc oxide as a main component, etc.

The oven shown in FIG. 1 has been known as said microwave heating oven.

In FIG. 1, a microwave generator (1) is coupled through a waveguide (2) to a microwave oven (3). A heating material (4) is placed on a supporting bed (7) in the microwave oven (3).

In said structure, the microwave generated by the microwave generator (1) is applied through the waveguide (2) to the microwave oven (3). Resonance electromagnetic field having various modes is formed in the microwave oven (3). When a material being heated (4) is placed in the microwave oven (3), the material (4) is heated by dielectric heating caused by the microwave.

Thus, uneven heating is caused for the material (4) in the conventional microwave oven because of uneven electromagnetic field. Moreover, it has been difficult to heat the material (4) at a temperature required for sintering a ceramic such as higher than 1000° C. because of heat radiation caused by radiation and natural convection. For example, a black sperical ball having a diameter of 7 cm is used as the material (4). The heat radiation caused by radiation at 1000° C. is given by the equation:

$$Q_1 = 4\pi\left(\frac{3.5}{100}\right)^2 4.88\left(\frac{1000+273}{100}\right)^4$$
$$= 1860 \text{ k cal/h}$$
$$= 2.16 \text{ kW}$$

The heat radiation caused by natural convection is given by the equation:

$$Q_2 = 4\pi\left(\frac{3.5}{100}\right)^2 10 \cdot 1000$$
$$= 154 \text{ k cal/h}$$
$$= 179 \text{ W}$$

wherein the heat transfer coefficient is 10 k cal/m$^2$·h·r·deg.

Therefore, the microwave input having greater than 2 kW has been required.

When the material (4) is a solid, it has been difficult to perform suitable impedance matching whereby heating efficiency has been disadvantageously low.

SUMMARY OF THE INVENTION

It is an object of the present invention to provide a microwave heating oven comprising an inner casing or particles made of a material being heated by microwave in which a material being heated is placed, and an intermediate casing made of a refractory insulator which causes less microwave loss and which covers said inner casing or particles and means for applying the microwave from outside of the intermediate casing into the inner casing or particles.

It is another object of the present invention to provide a microwave heating oven which can uniformly heat a material at high temperature with less electric power.

DETAILED DESCRIPTION OF THE PREFERRED EMBODIMENTS

Figure 1:
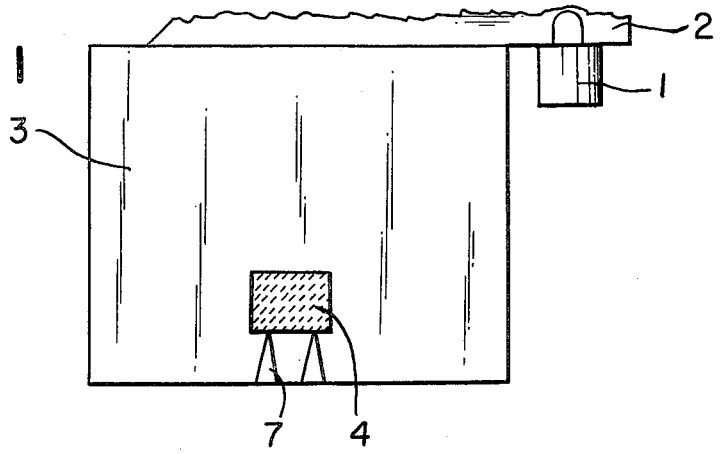
FIG. 1 is a sectional view of a conventional microwave heating oven.
Figure 2:
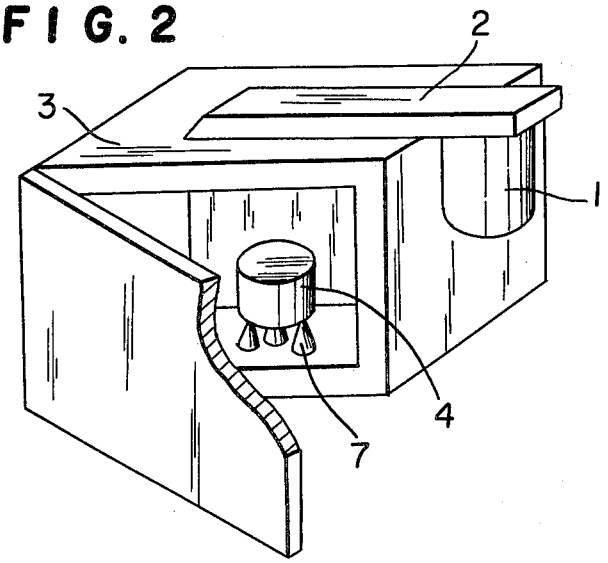
FIG. 2 is a schematic view of the conventional microwave heating oven of FIG. 1.
Figure 3:
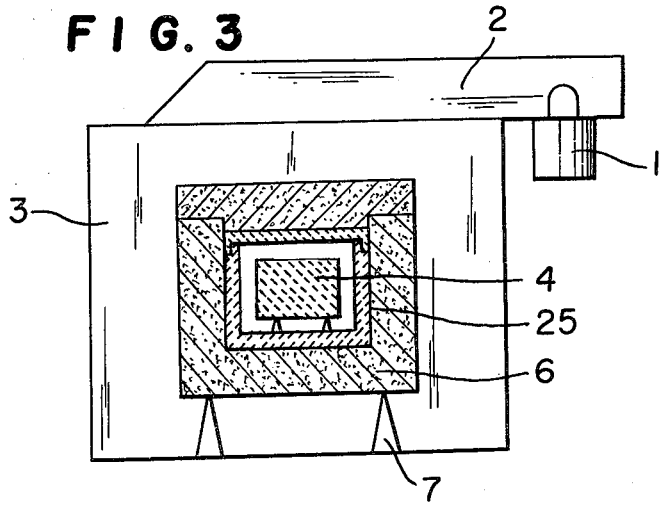
FIG. 3 is a sectional view of one embodiment of the microwave heating oven of the present invention.
Figure 4:
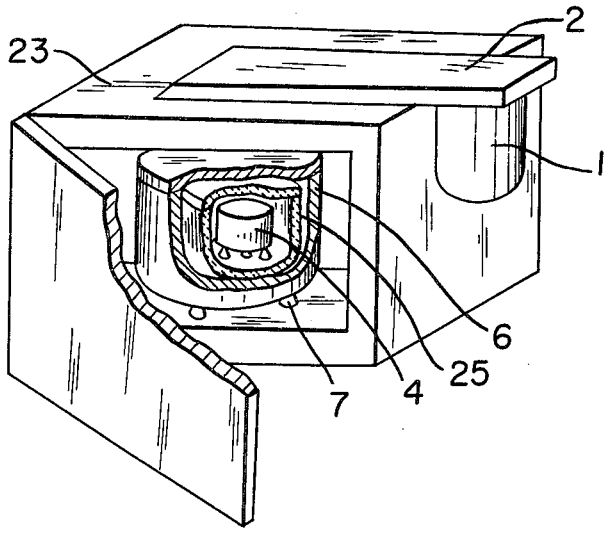
FIG. 4 is a schematic view of the furnace of FIG. 3.

One embodiment of a microwave heating oven of the present invention will be illustrated referring to FIGS. 3 and 4.

The microwave generator (1) is coupled through the waveguide (2) to the microwave oven (3) in which a material being heated (4) is placed. The material (4) is covered by an inner casing (25) made of a material being heated by microwave, such as a metal oxide having zinc oxide as the main component. A diameter of the inner casing (25) can be selected as desired such as about 90 mm. The inner casing (25) is covered by an intermediate casing (6) which is made of a refractory insulator which causes less microwave loss, and which can be a refractory insulating fire brick (Japanese Industrial Standard A-7) having a thickness of about 30 mm.

In said structure, the microwave generated by the microwave generator (1) is applied through the waveguide (2) to the microwave oven (3). Resonance electromagnetic field having various modes is formed in the microwave oven (3). The refractory insulator of the intermediate casing (6) has less microwave loss and accordingly, attenuation of the microwave is not substantially caused. Thus, the inner casing (25) made of the metal oxide having zinc oxide as the main component is directly heated. The inner casing (25) made of the metal oxide causes great microwave loss and has relatively high heat conductivity and excellent heat resistance and accordingly, an inner temperature can be uniformly maintained at high temperature such as higher than 1000° C. Thus, the material (4) in the inner casing (25) can be uniformly heated at high temperature such as higher than 1000° C.

Figure 5:
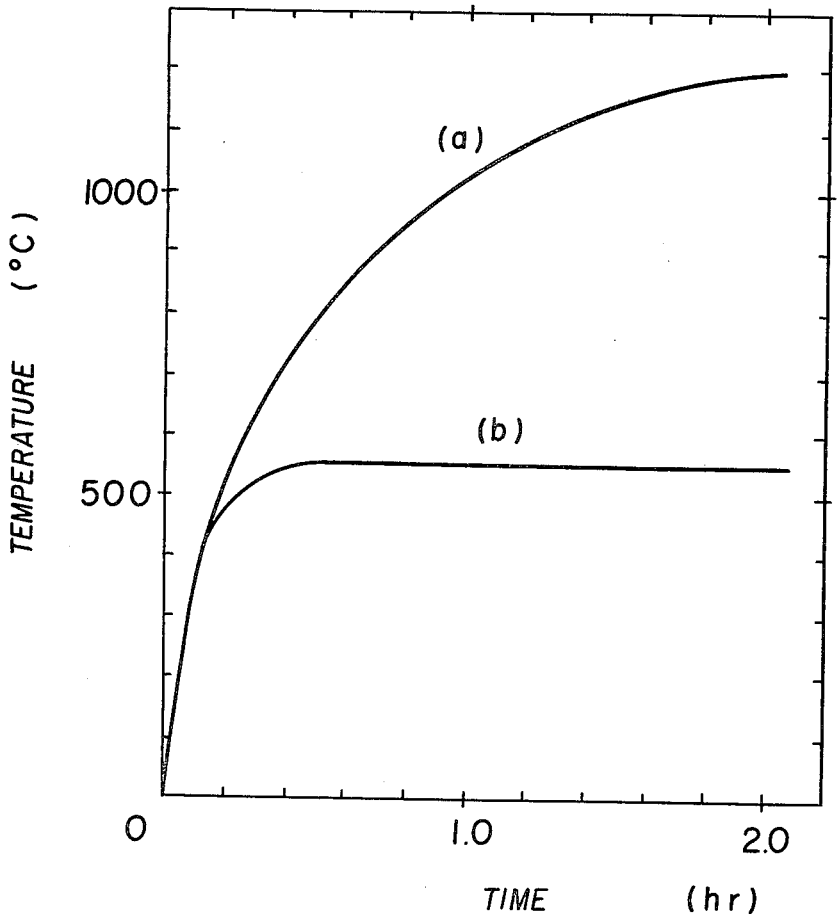
FIG. 5 is a graph of characteristic curves for comparing effects of the conventional one and the present invention.

FIG. 5 is a graph of (a) a temperature raising curve for the material in the microwave oven of the present invention and (b) a temperature raising curve for the material in the conventional microwave oven. The microwave input is 500 W in the tests.

Referring to FIG. 5, it is found that the temperature raising for the material reaches to equilibrium at about 500°–600° C. to stop further raising in the conventional microwave oven, whereas the temperature raising for the material result in heating to 1000° C. for about 1 hour and heating to higher temperature in the microwave oven of the present invention.

In said embodiment, the metal oxide having zinc oxide as the main component is used as the material being heated by the microwave which makes the inner casing (25) covering the material (4). Thus, it is possible to substitute it by a semiconductor having silicon carbide, or another material having high heat resistance which causes great microwave loss, such as a semiconductor having a main component of silicon carbide (SiC), or lanthanum chromate ($LaCrO_3$), or a material having a main component of zirconia ($ZrO_2$) in a form of a sintered material.

Figure 6:
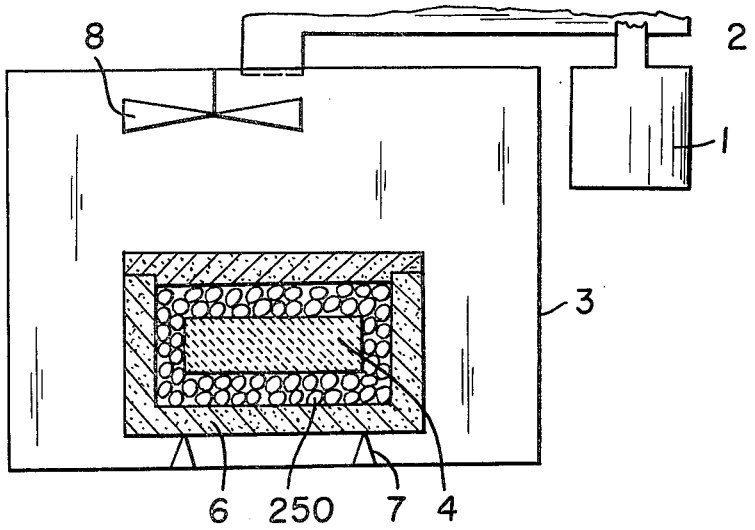
FIGS. 6, 7, 8, 9, 11, 12 and 13 are respectively sectional views of the other embodiments of the present invention.

FIG. 6 shows another embodiment of the present invention.

The material being heated (4) is covered by particles made of a heat resistant material which cause relatively great dielectric loss and the particles are covered by the intermediate casing (6) made of refractory insulator. The microwave is applied to them so as to heat the material (4). The particles for heating (250) which cover the material (4) have a diameter of about 1–10 mm and can be made of a heat resistant material which causes great induction loss such as a material having zinc oxide as the main component. The particles (250) are covered by the intermediate casing (6) made of a refractory insulator (such as Japanese Industrial Standard A-7).

The material (4) is placed in the microwave oven (3) equipped with a microwave resonator and the microwave is applied to it. The microwave passes through the intermediate casing (6) to heat the particles (250) which cause great induction loss. Thus, the material (4) is heated and sintered by the heat transfer from the particles (250) heated by the microwave at high temperature.

Figure 7:
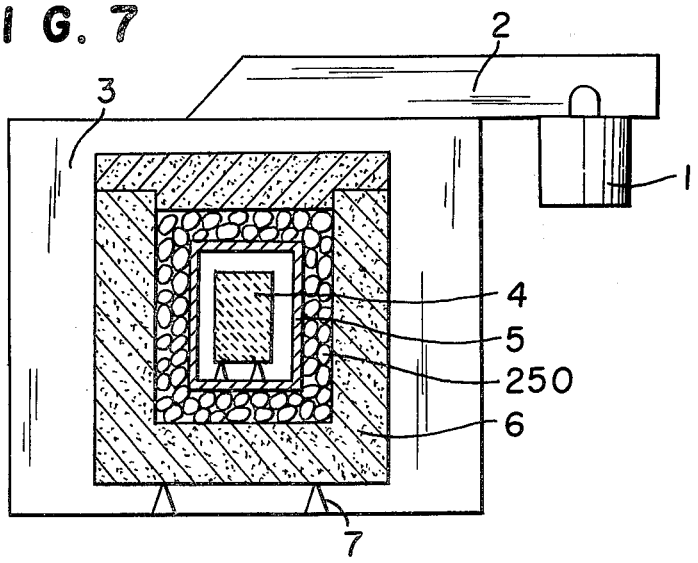

FIG. 7 is a sectional view of the other embodiment of the present invention.

The inner casing (5) is made of a heat resistant material having great heat conductivity such as an alumina porcelain. The material being heated (4) is kept in the inner casing (5). The particles for heating (250) are made of a heat resistant material which causes great microwave loss such as a metal oxide having zinc oxide as the main component and are filled in the intermediate casing (6) so as to cover the inner casing (5). The intermediate casing (6) hold the inner casing (5) in the particles (250) and is made of a refractory insulator which causes less microwave loss (such as Japanese Industrial Standard A-7).

The microwave loss of the intermediate casing (6) of the microwave oven is small whereby the attenuation of the microwave is not substantially caused and the temperature of the particles (250) gradually raise by the microwave. The heat radiation is shut by the intermediate casing (6) whereby the particles are heated at high temperature in high efficiency. The inner casing (5) is heated by the particles (250) heated at high temperature by the microwave. The inner casing (5) is made of the material having high heat conductivity whereby the whole of the inner casing (5) is uniformly heated at high temperature to form the uniform heat radiating space in it. Therefore, the material (4) placed in the inner casing (5) is uniformly heated at high temperature.

Figure 8:
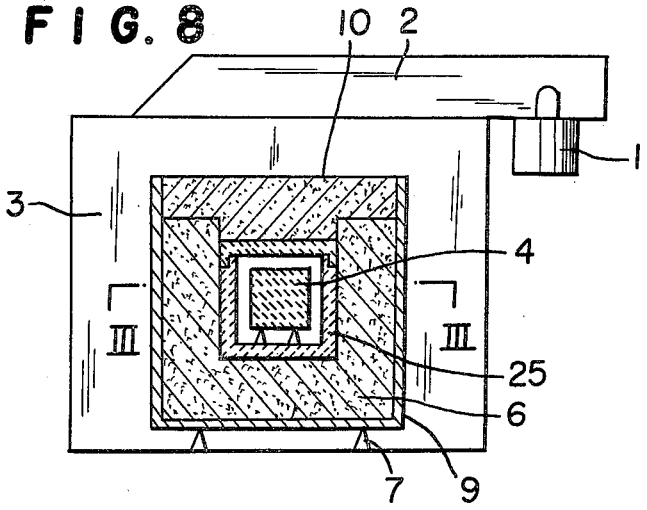

FIG. 8 shows the other embodiment of the present invention. The inner casing (25) made of a material having zinc oxide as the main component for heating by the microwave, is placed in the intermediate casing (6) made of a refractory insulator having less heat radiation coefficient $\epsilon$ which is placed in an outer casing (9) having a polished surface. The microwave can be applied through an opening (10). The outer casing (9) can be made of a metal having small heat radiation coefficient $\epsilon$ such as brass, aluminum, stainless steel or gold or can be plated by said metal.

Figure 9:
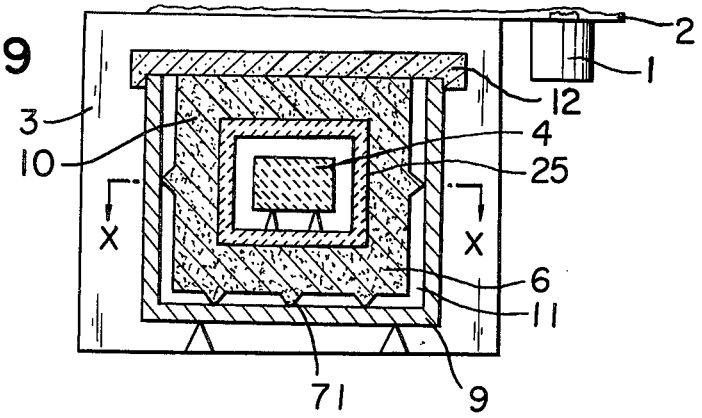
Figure 10:
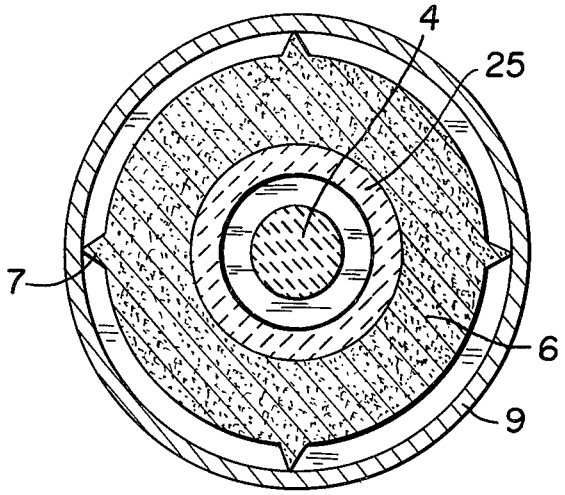
FIG. 10 is a sectional view taken along the line X—X of FIG. 9.

FIG. 9 is a sectional view of the other embodiment of the present invention and FIG. 10 is a sectional view taken along the X—X line of FIG. 9.

In this embodiment, the intermediate casing (6) is held in the outer casing (9) made of the material having small heat radiation coefficient $\epsilon$ so as to form spaces around the intermediate casing and the microwave is applied through the opening formed in the outer casing.

The inner casing (25) is the same as those of the other embodiments. The intermediate casing (6) has projections (71). The outer casing (9) is a cylindrical casing made of a material having small heat radiation coefficient $\epsilon$ and high electric conductivity such as copper, whose surface is polished. The opening (10) is formed for applying the microwave. A space (11) is sealed by a cover (12) which can be made of the refractory insulator for the intermediate casing (6).

Figure 11:
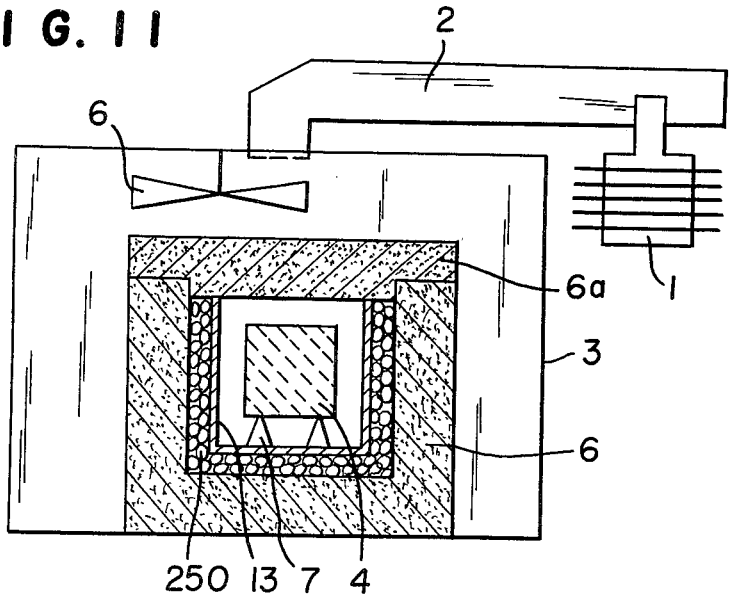

FIG. 11 is a sectional view of the other embodiment of the present invention, wherein the reference numeral (13) designates an inner casing made of a heat resistant metal such as stainless steel whose upper part is opened and which holds the material (4) and (6*a*) designates a cover for the intermediate casing (6) and the other references designate corresponding parts.

When the intermediate casing (6) having the inner casing (13) holding the material (4) is placed in the microwave oven (3) and the microwave is applied to it, the particles (250) are heated to high temperature for a short time. The inner casing (13) is heated by the heat conduction from the heated particles (250). Even though the particles (250) are ununiformly heated, the temperature of the inner casing (13) becomes uniform because of higher heat conductivity of the heat resistive metal than that of a ceramic. Therefore, the temperature of the inner casing (13) is uniform. Therefore, the uniform heat radiation space is formed in the inner casing (13) and the material (4) is uniformly heated.

The temperature raising can be performed at higher speed because the heat capacity of the inner casing (13) made of the heat resistant metal can be decreased.

Figure 12:
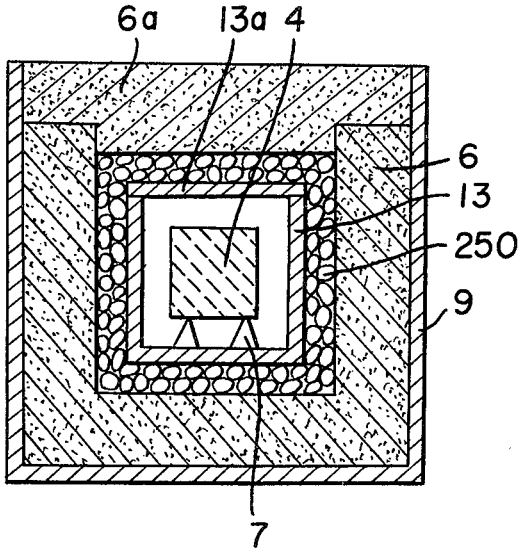

FIG. 12 is a sectional view of the other embodiment of the present invention wherein a cover (13*a*) made of a heat resistant metal is fitted to the upper part of the inner casing (13) and the intermediate casing (6) is covered by a cylindrical plate (9) made of a metal such as stainless steel, aluminum or copper, so as to improve the heat keeping effect by reflecting the radiation heat emitted from the inner part. The cylindrical plate (9) has an upper opening for applying the microwave inside thereof.

Figure 13:
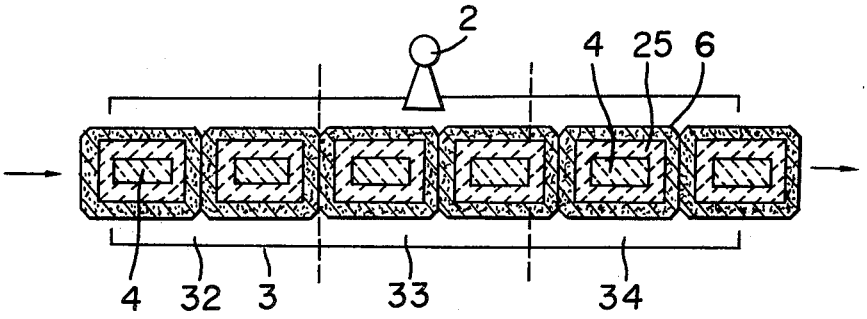

FIG. 13 is a sectional view of the other embodiment of the present invention, wherein the reference numeral (3) designates the microwave oven; (32), (33) and (34) respectively designate a temperature raising part, a temperature keeping part and a temperature falling part for the microwave oven (3); and (4) designates the material being heated which is covered by each intermediate casing (6) and each inner casing (25). The microwave generator (2) for applying the microwave to the microwave oven is connected. The inner casing (25) heated by the microwave has a thickness being less than the depth for penetrating the microwave.

The intermediate casings (6) are respectively fed into the temperature raising region, (32) the temperature keeping part (33) and the temperature falling part (34) in the microwave oven (3) at a constant speed.

We claim:

1. A microwave heating oven comprising:

means for generating microwaves;

an outer casing forming the walls of the heating oven;

means for transmitting microwave from said means for generating microwave into said outer casing;

an intermediate casing spaced from said outer casing, made of a refractory insulator which causes a relatively small microwave loss, where said intermediate casing includes a closure for allowing access to the inside of said intermediate casing;

an outer layer made of metal covering said intermediate casing and having an opening for applying microwave, the sides and bottom of said intermediate casing being spaced from said outer layer by means of integrally formed projections extending from the intermediate casing to the outer layer;

an inner casing placed contiguously with said intermediate casing and forming the walls of a receptacle having a closure for receiving an article to be heated, said inner casing being made of a material which is heated by microwave, said material including one substance selected from the group of zirconia ($ZrO_2$), zinc oxide (ZnO) and lanthanum chromate ($LaCrO_3$);

said inner casing including an inner layer spaced from said intermediate casing, with the space between the intermediate casing and the inner layer being filled with particulate material which is heated by microwave, whereby the entire inner layer is uniformly heated to a high temperature and acts to uniformly heat said receptacle within the inner layer by heat radiation from the inner layer;

wherein the outer layer reflects radiant heat emitted from the inner layer to improve the heat retention effect.

* * * * *